United States Patent [19]

Popplewell et al.

[11] 4,325,746

[45] Apr. 20, 1982

[54] SYSTEM FOR CLEANING METAL STRIP

[75] Inventors: James M. Popplewell, Guilford; Martin H. Dempsey, Stratford, both of Conn.

[73] Assignee: Olin Corporation, New Haven, Conn.

[21] Appl. No.: 235,813

[22] Filed: Feb. 19, 1981

Related U.S. Application Data

[63] Continuation of Ser. No. 80,400, Oct. 1, 1979, abandoned.

[51] Int. Cl.[3] ..... B08B 7/04; C23G 3/02

[52] U.S. Cl. ..... 134/10; 134/13; 134/15; 134/18; 134/26; 134/56 R; 134/57 R; 134/64 R; 134/105; 134/109; 134/113

[58] Field of Search ..... 134/10, 13, 15, 18, 134/26, 64 R, 98, 99, 103, 56 R, 57 R, 113, 105, 109

[56] References Cited

U.S. PATENT DOCUMENTS

| | | | |
|---|---|---|---|
| 2,325,158 | 7/1943 | Wood | 266/7 |
| 2,395,397 | 2/1946 | Croft | 15/7 |
| 2,471,506 | 5/1949 | Wiswall | 134/93 |
| 2,764,074 | 9/1956 | Rosenberg | 134/57 R |
| 3,048,503 | 8/1962 | Foote et al. | 134/9 |
| 3,062,223 | 11/1962 | Malin et al. | 134/57 |
| 3,441,035 | 4/1969 | Edwards | 134/103 |
| 3,562,015 | 2/1971 | Lancy | 134/13 |
| 3,623,532 | 11/1971 | Cofer et al. | 164/76 |
| 3,916,937 | 11/1975 | Nystrom | 137/255 |
| 3,951,682 | 4/1976 | Schevey et al. | 134/102 |
| 4,058,431 | 11/1977 | Haas | 156/627 |
| 4,105,469 | 8/1978 | Megy et al. | 134/3 |
| 4,111,715 | 9/1978 | Sprengling et al. | 134/10 |

FOREIGN PATENT DOCUMENTS 957904 8/1961 United Kingdom .

*Primary Examiner*—Marc L. Caroff

*Attorney, Agent, or Firm*—Barry L. Kelmachter; Paul Weinstein

[57] ABSTRACT

The system comprises a plurality of on-line cleaning tanks, through which continuous metal strip is passed, and a plurality of storage tanks, each containing a different cleaning solution. Different combinations of cleaning solutions are transferred to the on-line tanks from the storage tanks by selecting a particular combination or sequence of cleaning solutions in accordance with the type or composition of metal or metal alloy comprising the strip and automatically feeding the cleaning solutions to the on-line tanks in accordance with the sequence selected. The on-line tanks and storage tanks are interconnected by a network of conduits, pumps and valves which are automatically conditioned by a control element to operate in response to the selection of a particular cleaning sequence. Upon completion of a cleaning operation, each of the solutions is returned to its corresponding storage tank.

33 Claims, 11 Drawing Figures

STORAGE TANK 3
STORAGE TANK 2
STORAGE TANK 1
COMPUTER
CONTROL SYSTEM
10

SYSTEM FOR CLEANING METAL STRIP

CROSS-REFERENCES TO RELATED APPLICATIONS

This application is a continuation of application Ser. No. 80,400, filed Oct. 1, 1979, now abandoned.

U.S. patent application Ser. No. 104,244 filed Dec. 17, 1979 by Pryor et al. for "Copper Alloy Cleaning Process", now abandoned, and assigned to the assignee of the instant application discloses a cleaning/treatment process for which the apparatus of the instant invention is adapted.

BACKGROUND OF THE INVENTION

Effective cleaning of metals and alloys following forming and/or annealing operations is an extremely important processing step. Surface oxides and other contaminants must be removed from the surface of metal or alloy sheet, strip wire or tubular products prior to additional forming and/or treatment and/or storage of the product. Such cleaning is normally achieved using a variety of techniques including acid pickling, alkaline pickling, a combination of acid and alkaline pickling, brushing, etc., in a batch or continuous process. The design of the equipment utilized to carry out the cleaning process has a direct relation on the cost and effectiveness of such processes.

One of the major problems encountered in cleaning lines is the large number of different metal and alloy products which must be cleaned with the same equipment. Each particular metal or alloy is often characterized by different extents and types of surface contamination and may require a cleaning solution, or a series of cleaning solutions, which may be very different in composition and/or which may be required to be cleaned by solutions held at different temperatures. Conventional cleaning systems typically require long delays in draining and changing solutions as well as other delays in temperature stabilization where a solution or solutions required to be used at a specific temperature are utilized. In addition, some cleaning solutions require the use of a solution made up from a solid product which has to be dissolved in water or other liquids. This mixing and dissolving process is time consuming and results in considerable loss of operating efficiency and time of operation.

It would be highly desirable therefore to provide a treatment process and system to be utilized in a metal or alloy product treatment line which will provide greatly increased operating efficiency and extensive savings in time of operation of the cleaning line when cleaning a succession of different metal or alloy products.

PRIOR ART STATEMENT

Continuous multiple stage cleaning of a metal strip product is disclosed in U.S. Pat. No. 2,395,397 to Croft. A strip of metal is passed through a succession of spray, brush/spray, dry and spray stations. Spray nozzles spray the strip with a chemical solution at one station while at a latter station the strip is brushed during spraying with the same solution. The strip is finally washed and dried after all cleaning operations are completed. U.S. Pat. No. 2,395,397 shows a system whereby the cleaning solution is maintained at a particular level in a collecting tank located under the spray nozzles. The cleaning solution is pumped from a chemical solution settling tank into the collecting tank after which a separate pumping system pumps the solution from the settling tank to the spray nozzles. No provision is made for rapidly changing the cleaning solution supplied to the various settling tanks and spray nozzles to accomodate different types of metal or alloy products.

A system for supplying acid from an acid supply tank is depicted in U.S. Pat. No. 3,623,532 to Cofer et al. wherein an acid is utilized to pickle and quench a continuously cast metal rod after it leaves a rolling mill and before the rod is arranged in a coil. The acid supply tank passes the acid contained therein through a heat exchanger and various supply pipes of the system to an acid drain box, a middle acid injector and an acid injector and water drain. Again, no means are provided for economically and efficiently changing from one acid to another or from one chemical solution to another in a specific treatment portion of the line.

U.S. Pat. No. 4,058,431 shows a system for continuously regenerating an etching solution during a process of etching copper and copper base alloys. The regenerating apparatus comprises a reaction container for the etching solution and three supply containers located above the reaction container. The three supply containers are connected to the reaction container via conduits which are adapted to be opened and closed by a system of floats, valves, and necessary devices which form part of an electrical control system.

A control system for providing a series of cleaning and rinsing solutions to a plurality of milk handling devices is disclosed in British Pat. No. 957,904. This system utilizes a timer device and a plurality of valves, electrodes and conduits to first treat the milk handling devices with a nitric acid solution, followed by a soda solution and a rinsing solution, in that order.

The problem is that none of the systems described in the aforementioned prior art patents provide a means for treating, as for example by cleaning, a large number of different metals and alloys with different solutions in different sequence while utilizing a single unmodified system.

The present invention overcomes the deficiencies described above and provides an accurate and versatile means for providing different solutions in different sequence and at different temperatures as might be required when switching from treatment of one specific metal or alloy product to another or when it is desired to treat the same metal or alloy product in a different manner.

SUMMARY OF THE INVENTION

This invention relates to a process and system for cleaning and/or treating different metal and alloy product surfaces along a treatment line with different solutions and/or with solutions maintained at different temperatures.

In accordance with this invention a series of off-line storage tanks containing various solutions and/or solutions at various temperatures is provided. The storage tanks may be provided with special facilities for solution handling and storage, mixing, heating, metal recovery, regeneration and solids removal, particularly if a solid/liquid solution is used. A piping or conduit system controlled by a series of valves and pumps which may be manually or automatically operated connects the storage tanks to the treatment line. The entire system is provided with a flush capability which also may be manually or automatically operated.

Accordingly, it is an object of this invention to provide a process and system for on-line treating and/or cleaning of metal or alloy products which enables rapid and efficient transfer of different solutions or solutions having different temperatures or the like from off-line storage tanks to treatment tanks, thereby increasing both the efficiency and the versatility of the treatment line.

It is a further object of this invention to provide a versatile metal and alloy product treatment system which is readily adaptable to either manual or automatic control of the types and characteristics of the various solutions which are to be provided at various stations along a product treatment line.

These and other objects will become more apparent from the following description and drawings.

DETAILED DESCRIPTION OF THE PREFERRED EMBODIMENT

Figure 1:
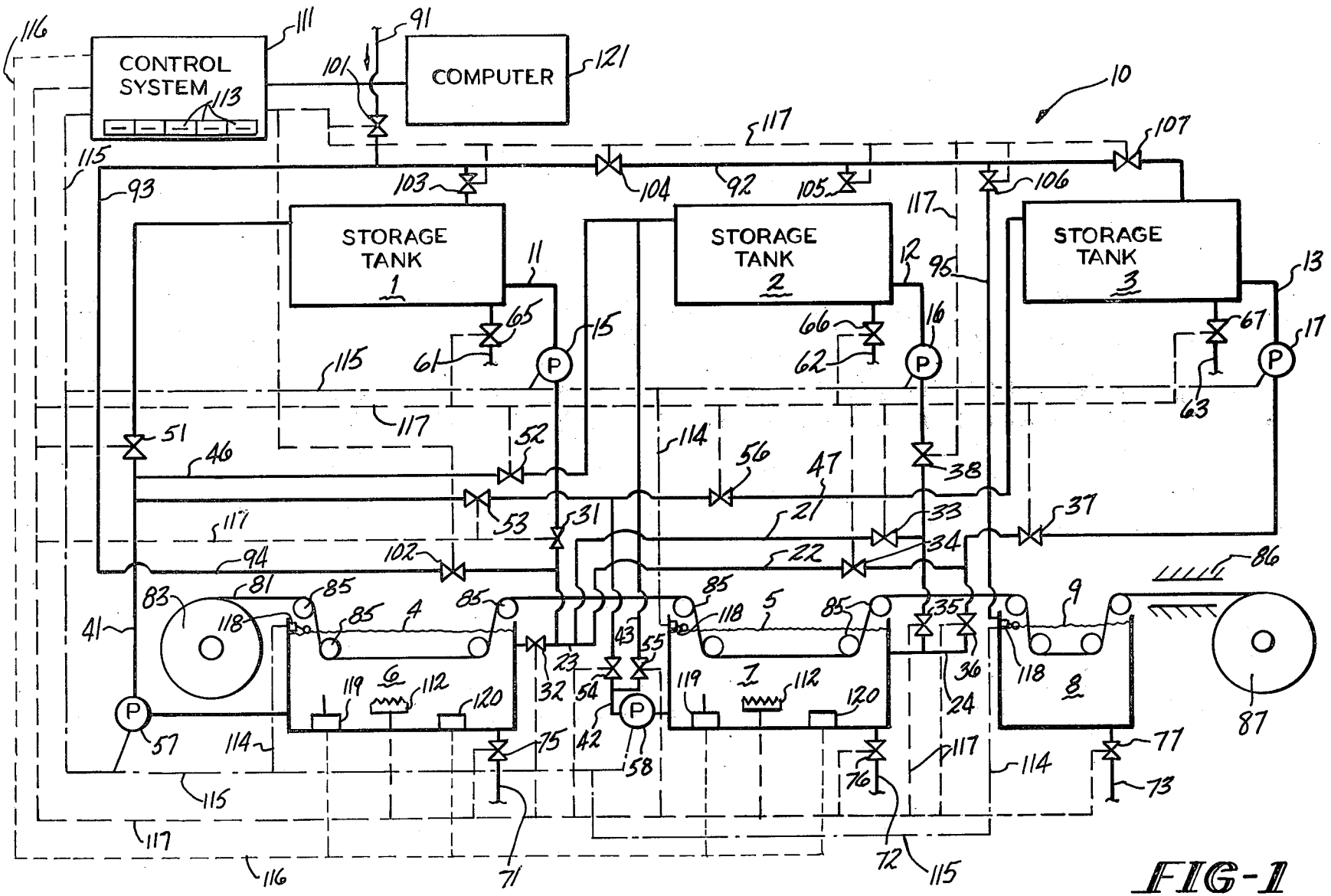
FIG. 1 is a schematic view in elevation of a preferred embodiment of a system for line treating a continuous metal or alloy strip product in accordance with the principles of the present invention.

FIG. 1 shows a schematic representation of a preferred embodiment of a metal or alloy strip cleaning system in accordance with this invention. The treatment tanks 6 and 7 are provided with cleaning solutions 4 and 5 while a rinse tank 8 is filled with a rinsing solution 9, usually water. A metal or alloy strip 81 is payed off a supply reel 83 and is passed over and around a series of rolls 85 so as to pass through the solutions contained in treatment tanks 6 and 7 and rinse tank 8. The cleaned and rinsed strip 81 is finally passed through a heating device 86 and is taken-up and wound about a storage reel 87.

Appropriate treating solutions are maintained off-line in storage tanks 1, 2 and 3. The solution in storage tank 1 can be supplied to treatment tank 6 via a supply conduit 11, a conduit branch 23 and supply valves 31 and 32. Storage tank 1 is also connected to treatment tank 7 via supply conduit 11 including supply valve 31, conduit branches 23 and 24, and either part of supply conduit 12 including supply valve 35 and conduit branch 21 including supply valve 33 or part of supply conduit 13 including supply valves 36, 37 and conduit branch 22 including supply valve 34. Solution from storage tank 1 is pumped through the system by pump 15.

The solution in storage tank 2 can be supplied to treatment tank 6 via supply conduit 12 including supply valve 28, conduit branch 21 including supply valve 33, and conduit branch 23 including supply valve 32. In like manner solution in storage tank 2 can be delivered to treatment tank 7 via supply conduit 12 including supply valves 38 and 35. Solution from storage tank 2 is pumped through the system by pump 16 provided in supply conduit 12.

Storage tank 3 is also connected to treatment tanks 6 and 7. Supply conduit 13 including supply valves 36 and 37 and conduit branch 24 connect storage tank 3 with treatment tank 7, while supply conduit 13 including supply valve 34 and conduit branch 23 including supply valve 32 connect storage tank 3 with treatment tank 6. Pump 17 pumps solution from storage tank 3 to both treatment tanks 6 and 7.

Solutions in treatment tanks 6 and 7 may be removed via drain conduits 71 and 72 by operation of valves 75 and 76 respectively for further treatment such as for removal of solids, metal recovery, etc. or may be returned to storage tanks 1, 2 and 3. Solution from treatment tank 6 is returned to storage tank 1 via return conduit 41 including return valve 51. Conduit branch 46 including return valve 52 allows for return of the solution in treatment tank 6 to storage tank 2 while conduit branch 47 including return valve 56 provides for return of the solution to storage tank 3. Return pump 57 pumps cleaning solution 4 from treatment tank 6 throughout the return system.

Treatment tank 7 is associated with a return pump 58 which pumps cleaning solution 5 through another return system of conduits and valves. Return conduit 42 including return valve 54 in conjunction with part of conduit branch 47 including return valve 53 and part of return conduit 41 including return valve 51 provide one route for returning cleaning solution 5 to storage tank 1, while another part of conduit branch 47 including return valve 56 provides a route for returning cleaning solution 5 to storage tank 3. Return conduit 43 including return valve 55 provides a system for returning cleaning solution 5 to storage tank 2.

Storage tanks 1, 2 and 3, normally provided with covers (not shown), conduits 61, 62 and 63 and drain valves 65, 66 and 67 respectively for draining of solutions to waste. It would of course be possible to drain the solutions for further processing, as for example for solid removal, metal recovery, or the like. Rinse tank 8 is also provided with a drain conduit 73 including a drain valve 77 for removal of rinsing water 9.

A water supply conduit 91 including valve 101 delivers water from a water source (not shown) to various parts of treatment system 10 to provide a source of water for preparation of solutions and to further provide a means for flushing the system. A water supply conduit branch 92 including valves 104 and 107 and branch valves 103 and 105 delivers water to storage tanks 1, 2 and 3 and also supplied water 9 to rinse tank 8 via water supply conduit branch 95 including valve 106. Water supply conduit branches 93 and 94 including valve 192 provide means for flushing the various supply conduits of the system and the treatment tanks 6 and 7.

All of the various valves of treatment system 10 are connected via control lines 117 to an automatic, partial automatic or manual control system 111. The various valves of system 10 may be operated hydraulically, electrically, or manually with control system 111 operating manually and/or automatically by means of switches and relays (not shown) located within control system 111. In like fashion, the various pumps within treatment system 10 are connected via control lines 115 to control system 111 and can be activated by action of the control system switches and relays.

Treatment tanks 6 and 7 are shown provided with temperature sensor devices 119, chemical solution testing devices 120, and heating devices 112. The temperature sensor devices 119 could typically be of the thermo-couple type and along with chemical solution testing devices 120 can be connected to control system 111 via control lines 116. The chemical solution testing devices could be of any type, and could for example be of the measuring electrode type disclosed in U.S. Pat. No. 4,058,431 to Haas. Heating devices 112 are shown as being connected to control system 111 via control lines 117 and may be of any suitable type, as for example, resistance heater to fluid heat exchange types of heat exchangers. The particular types of temperature and chemistry measuring, and heater devices utilized in conjunction with the treatment system 10 of this invention are given by way of example and may be of any type or variety for measuring or carrying out adjustment of solution parameters as desired.

Treatment tanks 6 and 7 and rinse tank 8 are also shown provided with float valves 118 of the type depicted in U.S. Pat. No. 2,395,397 to Croft. The float valves 118 may be of any type or construction and are shown connected to control system 111 via control lines 114 and 115.

The operation of treatment system 10 may be carried out by manual operation of switches 113 of control system 111 or by automatically activating the switches, relays and the like of control system 111 by computer 121.

The treatment system 10 in accordance with this invention is particularly suited for the cleaning of metals and alloys, such as for example, copper alloys. Depending on the composition, different copper alloys require the use of several different cleaning solutions and techniques. A few examples are provided below:

(a) Brasses, Copper, Copper-Nickel, Nickel Silver, and other common alloys are typically cleaned utilizing a 6–15% by volume solution of $H_2SO_4$ maintained at a temperature in the range of 100°–180° F.

(b) Aluminum brasses and other aluminum-containing alloys that form $Al_2O_3$ on annealing are typically cleaned in a first solution of 1 N NaOH maintained at a temperature in excess of 200° F. followed by treating with a second solution of $H_2SO_4$ as in (a) or a second solution of an oxidizing acid such as chromic or $H_2SO_4/H_{202}$.

(c) Silicon containing alloys are typically treated in an HF or oxidizing acid solution or by a first caustic solution such as NaOH followed by an oxidizing acid treatment.

(d) Leaded alloys are typically cleaned by an acetic acid solution or an $H_2SO_4$/acetic solution.

Thus, it can be seen that in a plant manufacturing a variety of copper alloys for example, three or more cleaning solutions are necessary in the minimum. In this context, referring now to FIG. 1, storage tank 1 could in accordance with this invention be filled with a solution of NaOH, while storage tanks 2 and 3 could be filled with $H_2SO_4$ and oxidizing acid solutions respectively.

Operation of treatment system 10 for cleaning strips of say for example aluminum bronzes followed by strips of silicon containing copper alloys would then be as follows:

All valves are closed initially, and all pumps are off. Supply valves 31 and 32 are opened and pump 15 is activated to pump the NaOH solution into treatment tank 6 till pump 15 is shut off and supply valves 31 and 32 are closed in response to an override switch (not shown) activated by float valve 118. Simultaneously with or after the filling of treatment tank 6 supply valves 38 and 35 are opened and pump 16 is activated thereby supply $H_2SO_4$ solution to treatment tank 7. Rinse tank 8 is supplied with rinsing solution prior to, during or after filling of treatment tanks 6 and 7 by opening valves 101, 104 and 106 along water supply conduit 91 till float valve 118 in rinse tank 8 causes an overriding switch (not shown) to close valves 101, 104 and 106. The cleaning line consisting of treatment tanks 6 and 7, rinsing tank 8 and heating device 86 is now ready to clean a strip 81 of aluminum bronze.

Assuming that after cleaning one or more aluminum bronze strips it is now desired to clean one or more strips of silicon containing copper alloys, it would be desirable for efficient operation of the treatment line to replace the $H_2SO_4$ solution in treatment tank 7 with the oxidizing acid solution in storage tank 3. To do this return valve 55 is opened and return pump 58 is turned on causing the $H_2SO_4$ solution in tank 7 to be returned to storage tank 2. The $H_2SO_4$ solution could also be optionally drained via drain conduit 72 by opening drain valve 76. Treatment tank 7 could be flushed if desired by opening valves 101, 102 and 33, 35 or 34, 36 thereby directing water from water supply conduit 91 into treatment tank 7. The supply valves 36 and 37 are opened and pump 17 is activated thereby filling treatment tank 7 with the oxidizing acid solution in storage tank 3. Pump 17 and valves 36 and 37 are shut off in response to a signal provided by float valve 118. It is understood that in a completely manual system, the pumps and valves can be optionally operated by visual measurement and observation and physical activation of the various valves and pumps.

As can be readily seen, the treatment system of FIG. 1 is such that the first and second treatment tanks 6 and 7 can be filled with any of the solutions found and stored in storage tanks 1, 2 and 3. This provides, among other possibilities, the capability of providing various cleaning sequences, eg. caustic-acid, double acid (to increase line speed or remove stubborn oxides without recleaning); oxidizing acid-acid (to remove refractory oxides and stains), or oxidizing acid-oxidizing acid (to remove internal oxidation or extremely resistant oxides). It should be quite apparent that such an arrangement would considerably increase the versatility of any copper and copper alloy as well as other metal cleaning operations and that the concepts of such a treatment system are readily adaptable to many types of cleaning and treating operations and plants.

The treatment system of this invention can be extended to as many storage and treatment tanks as desired. Aqueous degreasing solutions for example can be substituted for acids or alkalis.

It is also contemplated that the treatment system 10 depicted in FIG. 1 can be combined with various types of sub-systems, such as for example mixing, separation and regeneration sub-systems. In the ensuing descriptions, like numerals in the various drawing figures depict like parts.

Figure 2:
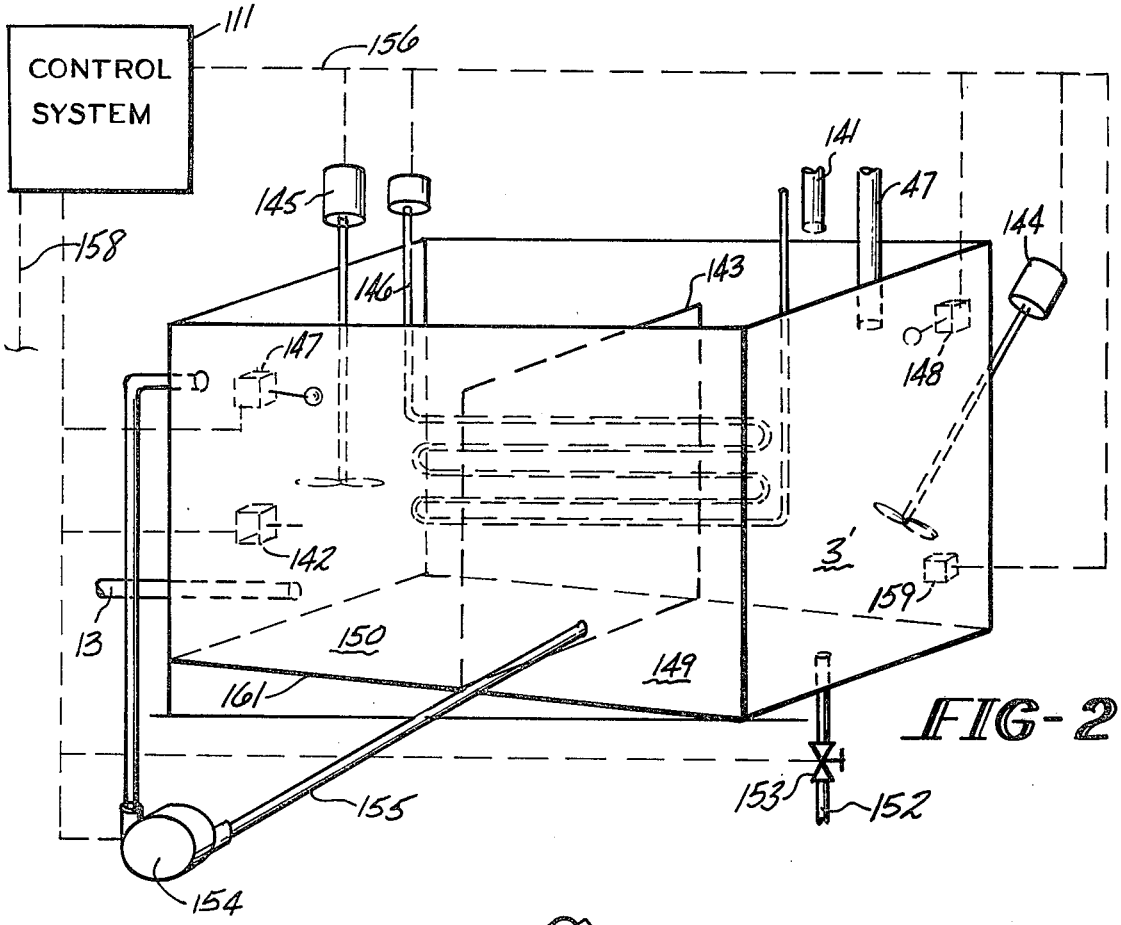
FIG. 2 is a schematic perspective view of an automatic mixing-storage tank arrangement which can be utilized in conjunction with the system of FIG. 1.
Figure 5:
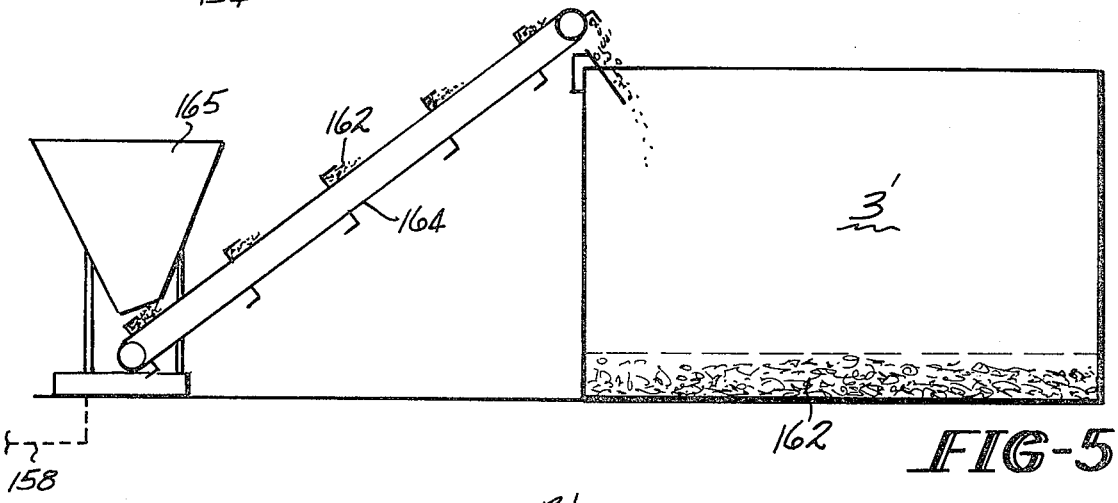
FIG. 5 is a side view of the mixing-storage tank of FIG. 2 showing a solid conveying system for charging the tank.

Referring to FIGS. 2 and 5 there is depicted therein a schematic of an automatic mixing arrangement. Certain solutions, particularly oxidizing acids, require mixing a solid in water or an acid. Examples of such solutions are sodium dichromate and ferric sulfate. Manual mixing of such solutions is both difficult and time consuming.

The mixing sub-system of FIGS. 2 and 5 comprises a mixing storage tank 3' having a sloped bottom 161 which slopes toward the primary mixing or mix side 149 of tank 3'. The sloped bottom 161 allows easy flushing of residual solids 162 from tank 3' via drain valve 153 and drain conduit 152. Mixing capability is provided in both primary mix side 149 and storage side 150 of tank 3' by mechanical mixers 144, 145. Mix side 149 is separated from storage side 150 by baffle or wall 143. Mixing can be provided optionally by mechanical, air or similar mixing devices, as desired.

Referring to FIGS. 2 and 5, solids are conveyed to the mix side 149 of tank 3' by a conveyor 164. The solids are delivered to conveyor 164 by a vibrating hopper 165. Conveyor 164 delivers solids to mix side 149 and liquid is provided via supply conduit 141. After mixing of the solution in mix side 149 pump 154 is activated thereby pumping the mixed solution through the transfer conduit 155 to storage tanks 1, 2 and 3 in FIG. 1. In the preferred embodiment of this invention mixing-storage tank 3' replaced one of the storage tanks, for example storage tank 3 in FIG. 1. Thus, supply conduit 13 (FIGS. 1 and 2) is utilized to deliver the mixed solution in storage side 150 to selected treatment tanks 6 or 7 while conduit branch 47 is utilized to return solution from the treatment tanks to mix side 149.

Mixing storage tank 3' is shown provided with a heater 146 for maintaining the solution in tank 3' at elevated temperatures. Heater 146 may be steam, electric or any other type of known heating device and may project through or around baffle or wall 143. Two separate heating devices might also be provided for mix side 49 and storage side 150.

While the conveyor system, mixing devices, pumps and valves of the mixing sub-system of FIG. 2 could be manually operated, it is contemplated in accordance with this invention to arrange such a sub-system for automatic operation. To this end, mix side 149 is provided with a float valve 148 while storage side 150 is provided with a similar float valve 147. Mix side 149 is also provided with a chemical solution testing device 159 while storage side 150 is also provided with a temperature sensor 142. Float valves 147, 158, temperature sensor 142, testing device 159, heater 146, drain valve 153, mixers 144 and 145, and pump 154 are all connected to control system 111 via control lines 156 while conveyor 164 and hopper 165 are connected to control system 111 via control lines 158.

Automatic operation of the mixing sub-system of FIGS. 2 and 5 are as follows: liquid and solid are delivered to mix side 149 by conveyor 164 and liquid supply conduit 141 upon receipt of signals from control system 111 and mixed by mixer 144. Float valve 148 acts via relays and override switches within control system 111 to cut off supply of liquid from supply conduit 141. Upon receiving a signal that the desired mixture as measured by chemical solution testing device 159 has been achieved control system 111 activates pump 154 to transfer the prepared solution to storage side 150 for eventual supply to the product treatment line. Temperature sensor 142 continuously monitors the mixed solution to determine whether it is at a selected desired temperature. Upon detecting the movement of solution below the selected temperature control system 111 is signalled and turns on heater 146.

When solution is returned to mix side 149 via conduit branch 47 after use it is automatically tested for chemical composition via chemical solution testing device 159, and the supply, mixing and transfer operation is essentially repeated as above.

Certain cleaning solutions require removal of solids which accumulate during the cleaning operation or which are present in the chemicals. Such solids can be separated by known separator devices which typically perform the separation by filtration or centrifuging of the cleaning solutions on a one time or continuous basis. In addition, chemical treatment of cleaning solutions to make them compatible with waste treatment procedures can produce solids which must be removed prior to discharge to waste. Such known separator devices can be readily inserted as a sub-system within the treatment system 10 of this invention.

Referring to FIGS. 3(A), 3(B), 3(C) and 3(D) there is depicted therein schematic representations of a separator 175 consisting typically of a centrifuge or filter system interposed in several different modes with storage tank 171, it being understood that storage tank 171 could be any one or more of the storage tanks 1, 2 or 3 of treatment system 10.

Figure 3A:
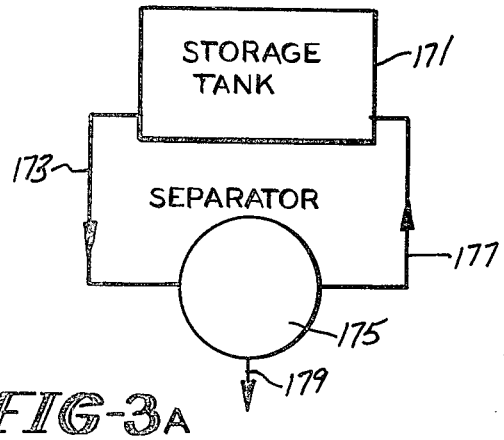
FIGS. 3(*a*), 3(*b*), 3(*c*) and 3(*d*) are schematic representations of four alternative centrifuge/filter sub-systems which can be utilized in conjunction with the treating system of FIG. 1.

Referring to FIG. 3(A), solution containing undesirable solids is transferred via conduit 173 to separator 175. Solids are disposed of via conduit 179 while the treated solution is returned to storage tank 171 via conduit 177.

FIG. 3 (B) is a variation of the solids removal sub-system of FIG. 3(A) with the difference that the treated solution, rather than being returned to storage tank 171 is supplied via any of supply conduits 11, 12 or 13 (FIG. 1) to one or more selected treatment tanks 6 or 7. In this embodiment, the net effect is that of interposing a separator between the storage tank and the treatment line .

Figure 3B:
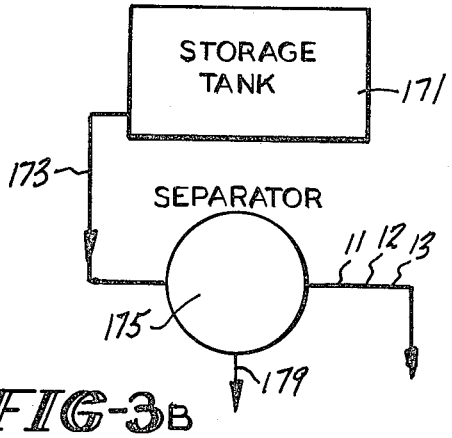
Figure 3C:
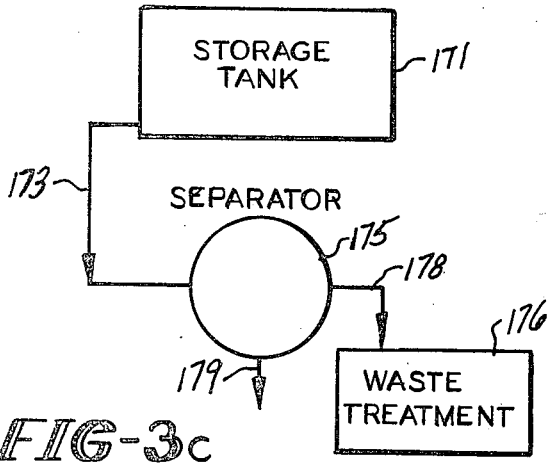

As an alternative to the sub-system of FIG. 3(B), FIG. 3(C) shows delivery of the treated solution to a waste treatment facility 176 via a conduit 178.

Figure 3D:
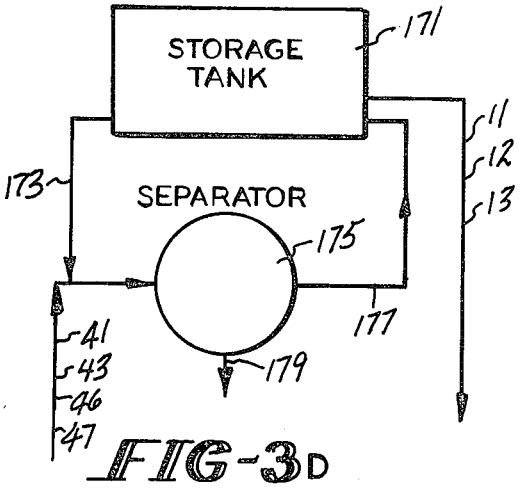

Finally, FIG. 3(D) shows an embodiment wherein solution from the treatment line of FIG. 1 is fed into separator 179 via any one or more of return conduits 41, 43 and conduit branches 46, 47 (FIG. 1) along with solution from storage tank 171. Treated solution is then transferred to storage tank 171 via conduit 177 as in FIG. 3(A) for eventual resupply to the treatment line.

Figure 4A:
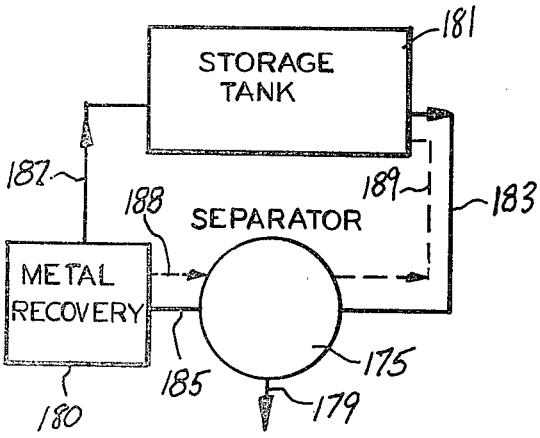
FIGS. 4(*a*) and 4(*b*) are schematic representations of two alternative recovery or regeneration sub-systems which can be utilized in conjunction with the treating system of FIG. 1.
Figure 4B:
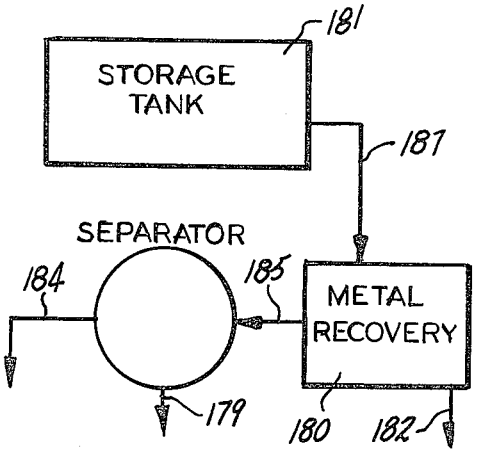

Metal recovery from cleaning and treatment solutions or regeneration of spent cleaning solutions either electrically or chemically is also economically attractive in metal treatment facilities. FIGS. 4(A) and 4(B) are schematic representations of how such regeneration equipment might be incorporated into the treatment system 10 of FIG. 1. As discussed above with respect to FIGS. 3(A) through 3(D) suspended solids can be removed by utilization of a separator as by centrifuging or filtering. In the embodiments of FIGS. 4(A) and 4(B) a metal recovery device 180 is utilized in conjunction with a separator 175. Again, storage tank 181 could be any one or more of the storage tanks in treatment system 10 (FIG. 1).

Referring to FIG. 4(A), solution from storage tank 181 is supplied to separator 175 via conduit 183, to metal recovery device 180 via conduit 185 and finally is returned to storage tank 181 via conduit 187. As an alternative, solution from storage tank 181 can be supplied first to metal recovery device 180 via conduit 187, and then to separator 175 via conduit 185, being returned to the storage tank 181 by conduit 183 after removal of the solids. It is also contemplated to supply solution from storage tank 181 to separator 175 and thereafter to metal recovery device 180 but returning the treated solution to storage tank 181 through conduits 188, 189 (FIG. 4(A), dotted) and separator 175. In this particular approach, solids are removed both before and after metal recovery.

FIG. 4(B) schematically represents another metal recovery-solids removal sub-system which may be incorporated into treatment system 10. Solution from storage tank 181 is supplied via conduit 187 to metal recovery device 180, after which the remaining solution is either discarded via conduit 182 or passed into separator 175 via conduit 185. From separator 175 solids can be removed via conduit 179 while treated solution is discarded via drain conduit 184.

As discussed hereinabove, recovery and regeneration of one or more of the treatment solutions utilized in treatment system 10 may be accomplished electrically or chemically, and suspended solids in such solutions can be removed by known centrifuging, settling or filtering techniques. In the embodiment of FIGS. 4(A) and 4(B) metal recovery is accomplished in a separate tank. However, recovery may also be readily accomplished in the storage tanks. Solids can then be removed via conduit 179 while treated solution is discarded via drain conduit 184.

As noted hereinabove, recovery and regeneration of one or more of the treatment solutions utilized in treatment system 10 can be accomplished electrically or chemically, and suspended solids in such solutions can be removed by known centrifuging or filtering techniques. In the embodiments of FIGS. 4(A) and 4(B) metal recovery is accomplished in a separate tank. However, recovery may also be readily accomplished in the storage tanks. Solids can then be removed with the FIG. 3(A) embodiment.

The treatment system and processes of this invention provides several advantages, e.g. all treatment solutions can readily be made up or subjected to treatment off-line, and in particular while the treatment line is in operation; all treatment solutions can be heated to cleaning temperature off-line and are immediately available for product treatment on being supplied to the appropriate treatment tank; continuous operation of the treatment line is readily made possible in view of off-line preparation and easy transfer of the solutions; solution chemistry can be stabilized during non-use; cleaning of and adjusting of solutions can be efficiently carried out during non-use and while the treatment line is in operation; and substantial energy conservation is obtained by maintaining storage tanks at constant temperature while they are in a holding mode.

Figure 6:
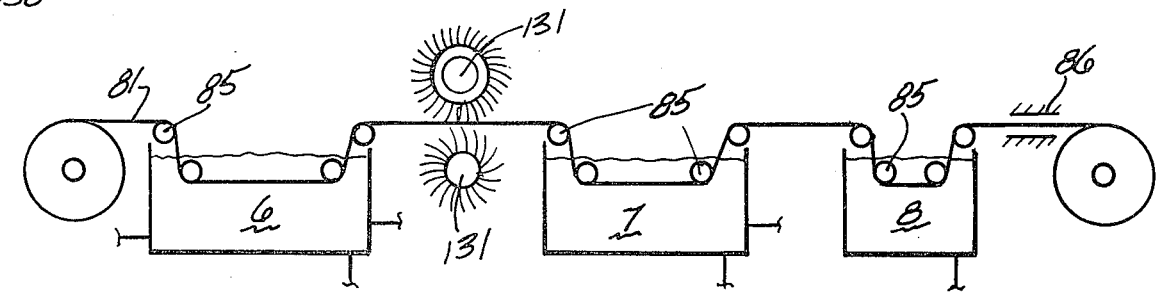
FIG. 6 is a partial schematic view of the system of FIG. 1 showing a brushing mechanism interposed between two treatment tanks in the metal or alloy treatment line.

The principles of the treatment system of this invention can be extended to as many holding and treatment tanks as desired. Aqueous degreasing solutions can be substituted for example for acids or alkalis. In addition other treatment elements and facilities can be utilized along the treatment line, being interposed with the various treatment tanks of the treatment system of this invention. Referring to FIG. 6, for example, a set of scrub brushes 131 is shown interposed between treatment tanks 6 and 7 of the treatment system 10 of FIG. 1. Such brushes can of course be utilized in and/or after any one or more of the treatment tanks of a treatment line.

Control system 111 can comprise an analog system made up of switches and relays for activating the various pumps and valves of treatment system 10. Manual switches 113 (FIG. 1) can be provided for every element of the treatment system for which manual operation is desired (only five such switches are shown for purposes of example). Each switch 113 could be marked as activating a designated valve or pump, or in the alternative could be used to activate a series of relays for activating a plurality of designated valves or pumps for say, a particular alloy strip material. An operator could throw selected switches 113 based also upon measured solution heights, chemistry, temperature, etc. although the preferred mode of operation would be to provide control system 111 with limit switches for automatic activation or cutoff of selected valves and pumps through interposition of a suitable relay device. It would of course be possible to operate treatment system 10 by manually activating the various valves and pumps directly rather than through control system 111.

The treatment system of this invention is readily susceptible to fully automatic operation by interposing elements such as control panels, temperature and chemical solution sensors, automatic valves and pumps, line speed control devices, and the like and utilizing such elements in conjunction with a computer.

Figure 7:
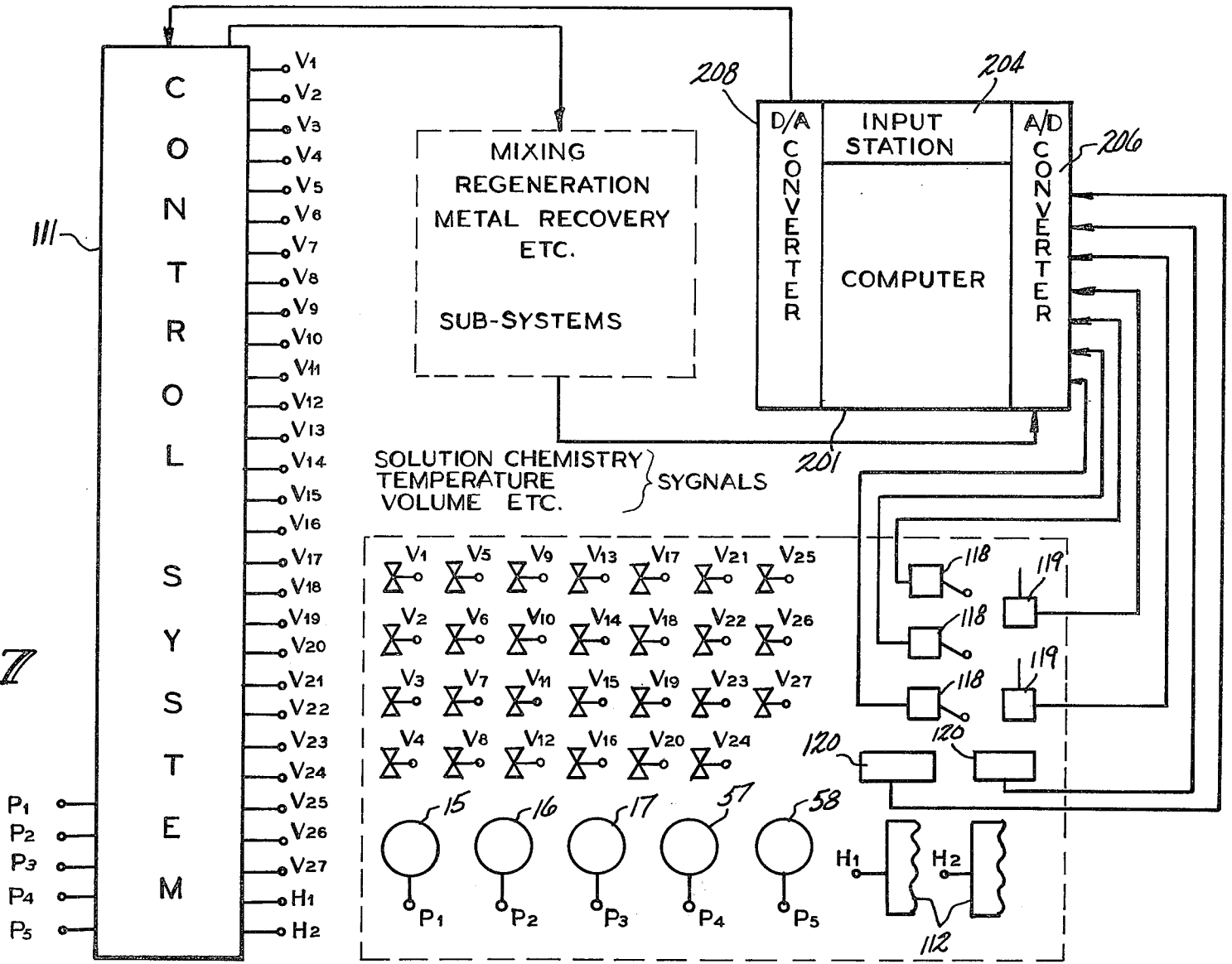
FIG. 7 is a block diagram of an automatic control and treatment system in accordance with a preferred embodiment of this invention.

Referring to FIG. 7, there is shown therein a block diagram of such an automatic treatment system in accordance with another preferred embodiment of this invention. Control system 111 with its various relays and switches is shown connected to pumps 15, 16, 17, 57 and 58 heaters 112 and the twenty-seven (27) valves of treatment system 10 (FIG. 1) as indicated by designated terminals P1 through P5, H1, H2 and V1 through V27 respectively. Automatic operation of control system 111 is achieved via computer 201 which is connected in parallel with analog control system 111 so that activation of the switches within control system 111 can be accomplished via computer 201. Computer 201 is shown in FIG. 7 separate from control system 111, but it should be understood that computer 201 can be considered to be a part of an overall control system for controlling the treatment line of this invention.

Computer 201 can be programmed in conventional manner to be responsive to input signals such as provided by punch cards or tapes fed to input station 204. The cards or tapes would provide information relating to the particular treatment process to be followed, including but not limited to the temperature and chemistry of the solutions desired, etc. It is contemplated that this information could be provided just by designating the particular type of metal or alloy which is to be treated. The program could also be such that computer 201 could receive digital signals via analog/digital converter 206. Analog/digital converter 206 is shown receiving analog from float valves 118, temperature sensor devices 119 and chemical solution testing devices 120 located within treatment system 10 (FIG. 1). Computer 201 then appropriately activates control system 111 in accordance with a pre-set program via digital signals which are converted by digital/analog converter 208 prior to activation of control system 111, thereby activating the appropriate valves, pumps, and heaters within treatment system 10.

Analog/digital converter 206 can also receive signals from whatever regeneration, recovery, and mixing subsystems are associated with the storage tanks of treatment system 10. Such signals could comprise for example signals from float valves 147, 148, temperature sensor 142 and chemical solution testing device 159 (FIG. 2). In response to these signals computer 201 via digital/analog converter 208 in accordance with a pre-set program would activate appropriate relays and switches in control system 111, which in turn would activate mixers 144, 145, pump 154, conveyor 164, valve 153, etc. (FIGS. 2 and 5) as required.

Computer 201 can be programmed to respond to activating signals from a conventional input station and/or from an analog/digital converter which in turn can be arranged in a circuit to receive signals from virtually any type of measuring, testing, and parameter device which it might be desired to utilize in maintaining an effective, economical and efficient metal, alloy or other product treatment line. The computer can therefore activate via digital/analog converter 208 switches and relays of control system 111 thereby carrying out the respective functions of the control system.

While portions of the disclosure of the invention herein refer specifically to the cleaning of copper and its alloys, it should be understood that the concepts of this invention can readily be applied to other materials. Likewise, although the treatment line disclosed herein is shown treating strip or sheet products in continuous coils it should nevertheless be obvious that this invention is readily adaptable to other products, as for example, wire, tube, and the like. Moreover, such a treatment line can be applied to any metals or non-metals that require one or more treating steps. Various operations such as for example degreasing, surface treatment, bright finishing as by etching, coating, and plating can be equally well accomplished in the treatment of this invention. Finally, the invention herein is adaptable to a system utilizing sprays rather than immersion tanks, for example, for supplying solution to spray devices such as those depicted in U.S. Pat. No. 2,395,397 to Croft.

It is apparent that there has been provided in accordance with this invention a versatile process and treatment system for the treatment of metal and alloy products which fully satisfies the objects, means and advantages set forth hereinbefore. While the invention has been described in combination with specific embodiment thereof, it is evident that many alternatives, modifications and variations will be apparent to those skilled in the art in light of the foregoing description. Accordingly, it is intended to embrace all such alternatives, modifications and variations as fall within the spirit and broad scope of the appended claims.

What is claimed is:

1. An apparatus for cleaning a continuous strip of metal or metal alloy comprising: a plurality of off-line storage tanks; said storage tanks containing a plurality of different cleaning solutions; at least two on-line cleaning tanks; means for passing said continuous strip through said on-line cleaning tanks; network means for transferring to and for removing from said on-line cleaning tanks said plurality of cleaning solutions; control means for selecting from among the plurality of cleaning solutions at least one of said cleaning solutions for each of said on-line cleaning tanks; said control means having at least a first mode for operating said network means to provide a same one of said cleaning solutions for each of said on-line cleaning tanks; said control means having at least a second mode for operating said network means to provide different ones of said cleaning solutions to different ones of said on-line tanks; said control means including means for selecting one of said modes in accordance with the type or composition of metal or metal alloy comprising said strip and means for automatically conditioning said apparatus to operate in response to said selected mode.

2. An apparatus for cleaning a continuous strip as in claim 1 wherein said network means comprises fluid conduits, valves and pumps interconnecting said off-line storage tanks and said at least two on-line cleaning tanks.

3. An apparatus for cleaning a continuous strip as in claim 2 including nozzle means associated with at least one of said on-line cleaning tanks for spray treating said strip.

4. An apparatus for cleaning a continuous strip as in claim 2 wherein said automatic conditioning means selectively activates said fluid conduits, valves and pumps whereby said one selected mode is provided to said at least two on-line cleaning tanks.

5. An apparatus for cleaning a continuous strip as in claim 1 wherein said automatic conditioning means comprises a plurality of switches.

6. An apparatus for cleaning a continuous strip as in claim 4 including means for conditioning at least one of said cleaning solutions to carry out a predetermined cleaning function on said strip.

7. An apparatus for cleaning a continuous strip as in claim 6 wherein said means for conditioning said at least one cleaning solution includes sensing means associated with at least one of said storage and cleaning tanks, said sensing means including monitoring means for generating at least one signal representative of at least one of the depth, temperature and chemical composition of at least one of said cleaning solutions.

8. An apparatus for cleaning a continuous strip as in claim 6 wherein said means for conditioning said at least one cleaning solution includes means associated with at least one of said storage tanks for mixing at least one of said cleaning solutions.

9. An apparatus for cleaning a continuous strip as in claim 6 wherein said means for conditioning said at least one cleaning solution includes means for recovering metal from at least one of said cleaning solutions.

10. An apparatus for cleaning a continuous strip as in claim 6 wherein said means for conditioning said at least one cleaning solution includes means for removing solids from at least one of said cleaning solutions.

11. An apparatus for cleaning a continuous strip as in claim 6 wherein said means for conditioning said at least one cleaning solution includes means associated with at least one of said storage and cleaning tanks for heating at least one of said cleaning solutions.

12. An apparatus for cleaning a continuous strip as in claim 1 wherein said automatic conditioning means includes computer means for automatically activating said control means in response to recorded and monitored input signals and for acting as said selecting means.

13. An apparatus for cleaning a continuous strip as in claim 6 wherein said automatic conditioning means includes computer means for automatically activating said control means in response to recorded and monitored input signals.

14. An apparatus for cleaning a continuous strip as in claim 7 further comprising computer means for automatically activating said control means in response to said at least one signal from said monitoring means.

15. An apparatus for cleaning a continuous strip of metal or metal alloy comprising: a plurality of off-line storage tanks; said storage tanks containing a plurality of different cleaning solutions; at least two on-line cleaning tanks; means for passing said continuous strip through said on-line cleaning tanks; network means for transferring to and for removing from said on-line cleaning tanks said plurality of cleaning solutions; control means for selecting from among the plurality of cleaning solutions at least one of said cleaning solutions for each of said on-line cleaning tanks; said control means having at least a first mode for operating said network means to provide a first set of cleaning solutions in said on-line cleaning tanks and at least a second mode for operating said network means to provide a second set of cleaning solutions different from said first set in said on-line cleaning tanks; said control means including means for selecting one of said modes in accordance with the type or composition of metal or metal alloy comprising said strip and means for automatically conditioning said apparatus to operate in response to said selected mode.

16. An apparatus for cleaning a continuous strip as in claim 15 wherein said first set of cleaning solutions comprises different ones of said plurality of cleaning solutions.

17. An apparatus for cleaning a continuous strip as in claim 16 wherein said second set of cleaning solutions comprises a same one of said plurality of cleaning solutions in each of said on-line cleaning tanks.

18. A process for cleaning a continuous strip of metal or metal alloy comprising the steps of:

providing a system having a plurality of off-line storage tanks and a cleaning line comprising at least two on-line cleaning tanks;

maintaining a plurality of cleaning solutions in said storage tanks;

providing said cleaning line with a first mode for cleaning said strip comprising a first set of cleaning solutions;

providing said cleaning line with a second mode for cleaning said strip comprising a second set of cleaning solutions different from said first set of cleaning solutions;

selecting at least one of said first and second sets of cleaning solutions in accordance with the type or composition of metal or metal alloy comprising said strip;

generating a signal indicative of said selected set;

automatically conditioning said system in response to said signal for delivering said selected set of cleaning solutions to said cleaning tanks from said storage tanks; and passing said strip through said cleaning tanks.

19. A process as in claim 18 further comprising establishing a network of fluid conduits, valves and pumps in interconnecting relationship with said off-line storage tanks and said at least two on-line cleaning tanks wherein said delivering is carried out by activating selected ones of said valves and pumps.

20. A process as in claim 18 wherein the step of automatically conditioning comprises selectively activating said network of fluid conduits, valves and pumps in response to first input signals.

21. A process as in claim 20 wherein the step of selectively activating comprises activating selected ones of said valves and pumps by operation of at least one switch.

22. A process as in claim 20 including the step of conditioning at least one of said cleaning solutions to carry out a predetermined cleaning function on said strip.

23. A process as in claim 22 including the steps of: monitoring characteristics including at least one of the depth, temperature and chemical composition of said cleaning solutions; and generating second input signals representative thereof such that said step of conditioning said at least one cleaning solution is carried out in response to said second input signals.

24. A process as in claim 22 wherein said step of conditioning said at least one cleaning solution includes the step of mixing at least one cleaning solution off-line.

25. A process as in claim 22 wherein said step of conditioning said at least one cleaning solution includes the step of recovering metal from at least one of said cleaning solutions.

26. A process as in claim 22 wherein said step of conditioning said at least one cleaning solution includes the step or removing solids from at least one of said cleaning solutions.

27. A process as in claim 22 wherein said step of conditioning said at least one cleaning solution includes the step of heating at least one of said cleaning solutions.

28. A process as in claims 20 or 22 wherein the step of selectively activating is carried out automatically by utilizing a computer to monitor said first input signals and to activate selected ones of said valves and pumps.

29. A process as in claim 23 wherein said step of conditioning said at least one cleaning solution is carried out automatically by utilizing a computer to monitor said second input signals and to activate means for conditioning said at least one cleaning solution.

30. A process as in claim 29 including the steps of: programming said computer to automatically activate the selected ones of said valves and pumps and said at least one cleaning solution conditioning means in response to said first and second input signals; and continuously monitoring said first and second input signals through at least one input station associated with said computer to effect the steps of automatically conditioning said system and conditioning said at least one cleaning solution in a predetermined and preprogrammed manner.

31. The process of claim 18 wherein the step of providing a first mode includes providing a same one of said cleaning solutions to each of said cleaning tanks.

32. The process of claim 31 wherein the step of providing a second mode includes providing different ones of said cleaning solutions to different ones of said cleaning tanks.

33. The process of claim 18 wherein the step of selecting at least one of said sets comprises determining the metal or metal alloy comprising said strip.

* * * * *

UNITED STATES PATENT AND TRADEMARK OFFICE

CERTIFICATE OF CORRECTION

PATENT NO. : 4,325,746

DATED : April 20, 1982

INVENTOR(S) : James M. Popplewell and Martin H. Dempsey

It is certified that error appears in the above—identified patent and that said Letters Patent is hereby corrected as shown below:

In Column 14, line 29, the word "or" should read ——of——.

Signed and Sealed this

*Fourteenth* Day of *December 1982*

[SEAL]

*Attest:*

GERALD J. MOSSINGHOFF

*Attesting Officer*

*Commissioner of Patents and Trademarks*